US008460617B2

(12) United States Patent
Schacher et al.

(10) Patent No.: US 8,460,617 B2
(45) Date of Patent: Jun. 11, 2013

(54) PIPETTE TIP AND A METHOD FOR PIPETTING A CONGEALED BLOOD SAMPLE UTILIZING THE PIPETTE TIP

(75) Inventors: Gottlieb Schacher, Kriens (CH); Rolf Schneebeli, Mettmenstetten (CH); Hans-Peter Wahl, Huenenberg (CH)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 887 days.

(21) Appl. No.: 12/512,171

(22) Filed: Jul. 30, 2009

(65) Prior Publication Data

US 2010/0028934 A1 Feb. 4, 2010

(30) Foreign Application Priority Data

Jul. 30, 2008 (EP) ..... 08013657

(51) Int. Cl.
*B01L 3/02* (2006.01)

(52) U.S. Cl.
USPC ..... 422/525; 422/524; 436/180; 73/864.01

(58) Field of Classification Search
USPC ..... 422/501, 524, 525; 73/864.01; 436/180
See application file for complete search history.

(56) References Cited

U.S. PATENT DOCUMENTS

| | | | | |
|---|---|---|---|---|
| 3,276,847 | A * | 10/1966 | Duff et al. | 422/523 |
| 4,347,875 | A * | 9/1982 | Columbus | 422/501 |
| 4,707,337 | A * | 11/1987 | Jeffs et al. | 422/525 |
| 4,721,680 | A | 1/1988 | Jeffs et al. | |
| 4,999,164 | A * | 3/1991 | Puchinger et al. | 422/513 |
| 7,361,312 | B2 * | 4/2008 | Takeda et al. | 422/525 |
| 7,794,664 | B2 * | 9/2010 | Pelletier et al. | 422/400 |
| 2002/0076826 | A1 | 6/2002 | Jacobs et al. | |
| 2006/0177352 | A1 | 8/2006 | Ziegmann et al. | |

FOREIGN PATENT DOCUMENTS

| | | | |
|---|---|---|---|
| EP | 1 839 752 | A2 | 3/2007 |
| JP | 11 153605 | A | 6/1999 |
| JP | 11153605 | A * | 6/1999 |

* cited by examiner

*Primary Examiner* — Jan Ludlow
(74) *Attorney, Agent, or Firm* — Dinsmore & Shohl, LLP

(57) ABSTRACT

A pipette tip and a method for pipetting a congealed blood sample utilizing the pipette tip are disclosed. The pipette tip includes an attachment section configured to be attached to a dispensing device, a liquid containing section configured to receive at least part of an aspired liquid sample, and a liquid aspiration section that is connected to the liquid containing section. The liquid aspiration section has a distal end aspiration opening and at least one further aspiration opening in a side wall.

17 Claims, 2 Drawing Sheets

PIPETTE TIP AND A METHOD FOR PIPETTING A CONGEALED BLOOD SAMPLE UTILIZING THE PIPETTE TIP

TECHNICAL FIELD

Embodiments of the invention refer generally to pipetting, and particular to a pipette tip and a method for pipetting a congealed blood sample utilizing the pipette tip.

BACKGROUND

Pipette tips are used in connection with a pipette or dispensing device in order to extract partial amounts of liquids from a liquid containing reservoir and subject them to a further use, e.g. a subsequent examination or analysis.

A pipette tip is, for example, described in the document EP 1 839 752 A1. The pipette tip is designed as a disposable tip. It has a configuration with an attachment section and a connected section to collect the pipetted liquid at the end of which there is an aspiration opening.

Blood samples are often pipetted in order to subject the pipetted liquid to a subsequent blood sample purpose. For this, congealed blood is differentiated from non-congealed blood. Regarding the pipetting of congealed blood, the important thing is to obtain the liquid component of the blood sample which can be further processed. Known pipette tips have the problem that they immediately become blocked at the first aspiration. The reason for this is that the so-called blood clot is aspirated, the pipette tip penetrates it and this leads to the blockage. In order to avoid the blockage effect, congealed blood is usually first centrifuged in order to separate the blood clot from the liquid component. The liquid component can then be pipetted.

SUMMARY

It is against the above background that an improved pipette tip for which the range of applications in pipetting liquid samples is extended is disclosed herein.

In one embodiment, a pipette tip comprising an attachment section configured to be attached to a dispensing device is disclosed. The pipette tip further includes a liquid containing section configured to receive at least part of an aspired liquid sample, and a liquid aspiration section that is connected to the liquid containing section. The liquid aspiration section comprises a distal end aspiration opening and at least one further aspiration opening in a side wall.

In another embodiment, a method for pipetting a congealed blood sample is disclosed. The method comprises utilizing a pipette tip according an embodiment of the invention in a pipette device.

Following, the invention will be described in further detail, by way of example, with reference to different embodiments.

BRIEF DESCRIPTION OF THE DRAWINGS

The embodiments set forth in the drawings are illustrative and exemplary in nature and not intended to limit the inventions defined by the claims. The following detailed description of the illustrative embodiments can be understood when read in conjunction with the following drawings, where like structure is indicated with like reference numerals and in which:

DETAILED DESCRIPTION

According to the various embodiments of the invention a pipette tip and a method for pipetting a congealed blood sample utilizing the pipette tip are provided.

Figure 1:
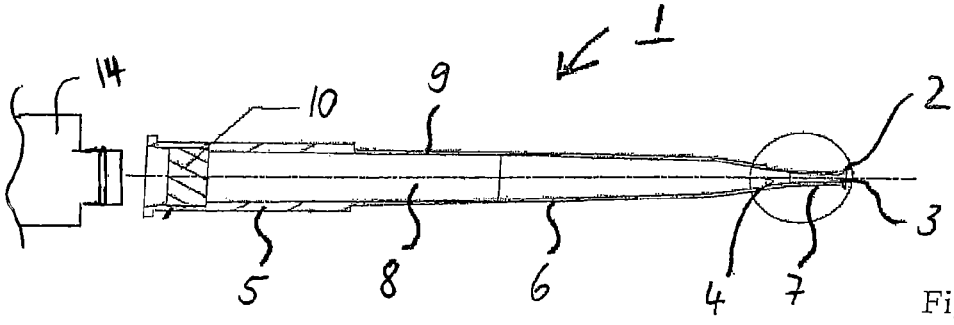
FIG. 1 is a longitudinal cross-section view of a pipette tip according to one embodiment having a blunt distal end tip with a distal end aspiration opening and a plurality of further aspiration openings.

FIG. 1 shows a pipette tip 1 having a blunt distal end tip 2 with a distal end aspiration opening 3 and a plurality of further aspiration openings 4. The pipette tip 1 has an attachment section 5 which is designed to attach the pipette tip 1 to a pipette device 14, for example by being pushed in or gripped. The attachment section 5 is connected to a liquid containing section 6. Connected to the liquid containing section 6 is a liquid aspiration section 7. The distal end aspiration opening 3 is connected to an inner space 8 of the pipette tip 1 which is surrounded by a side wall 9. A filter element 10 is also provided in the inner space 8 of the pipette tip 1 which is surrounded by the side wall 9. The filter element 10 is, for example, made of a porous material and serves e.g. to prevent contamination of the pipette device 14 with spills of liquid sample being pipetted.

Figure 2:
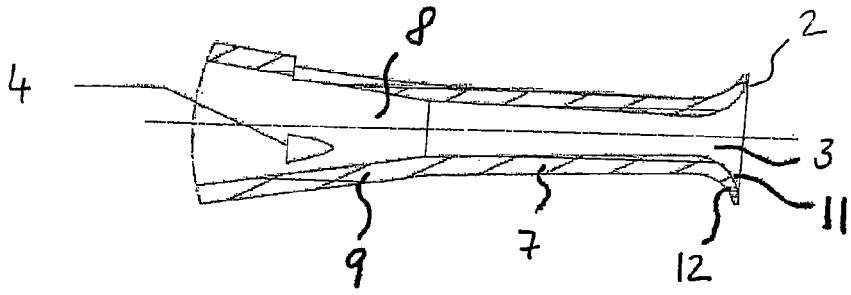
FIG. 2 is an enlarged view of a liquid aspiration section of the pipette tip in FIG. 1 in greater detail.

FIG. 2 shows the liquid aspiration section 7 of the pipette tip 1 in FIG. 1 in greater detail.

It follows that the distal end aspiration opening 3 is surrounded by a projecting lip 11, which then forms a trumpet shaped end 12. When pipetting congealed blood, the blood clot can attach itself to the trumpet shaped end 12 without the pipette tip 1 penetrating it to any great degree so that the blood clot can fall away on its own later. It is to be appreciated that temporarily attaching the blood clot to the distal end due to the projecting shape has an advantage, which is that to retain the clot at the distal end thus prevents it from blocking the laterally located further aspiration openings 4.

In the liquid aspiration section 7 the further aspiration openings 4 are provided in the side wall 9. When pipetting, the liquid to be pipetted can reach the inner space 8 of the pipette tip 1 through the further aspiration openings 4. The further aspiration openings 4 constitute further distal end aspiration openings. Furthermore, after the pipette tip 1 is removed from the sample to be pipetted, a venting of the air occurs through the further aspiration openings 4 causing a partial or complete neutralization of the low pressure in the inner space 8 of the pipette tip 1. This contributes to let the non-pipettable elements around the distal end aspiration opening 3 fall away. The further aspiration openings 4 thus have also the function of venting openings.

Figure 3:
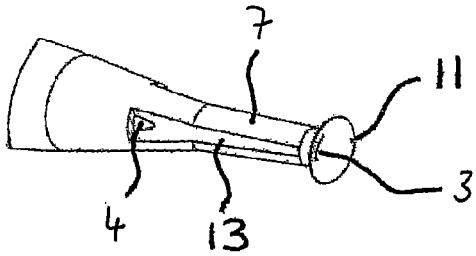
FIG. 3 is a perspective view of the liquid aspiration section in FIG. 2.

FIG. 3 shows a perspective view of the liquid aspiration section 7 in FIG. 2. It can be seen that recesses 13 are provided in front of the further aspiration openings 4. The recesses 13 can be realized as grooves.

Figure 4:
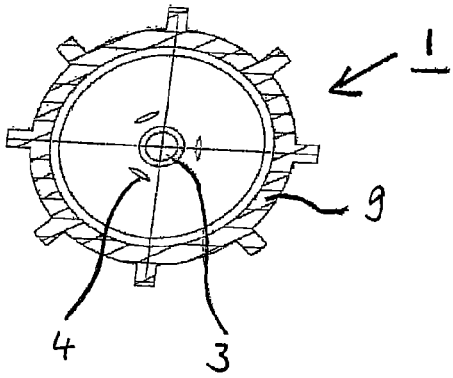
FIG. 4 is a top view of the pipette tip in FIG. 1.

FIG. 4 shows a top view of the pipette tip 1 in FIG. 1.

In the following, further embodiments shall be described which use the same reference signs as in FIG. 1 to 4 for similar features.

Figure 5:
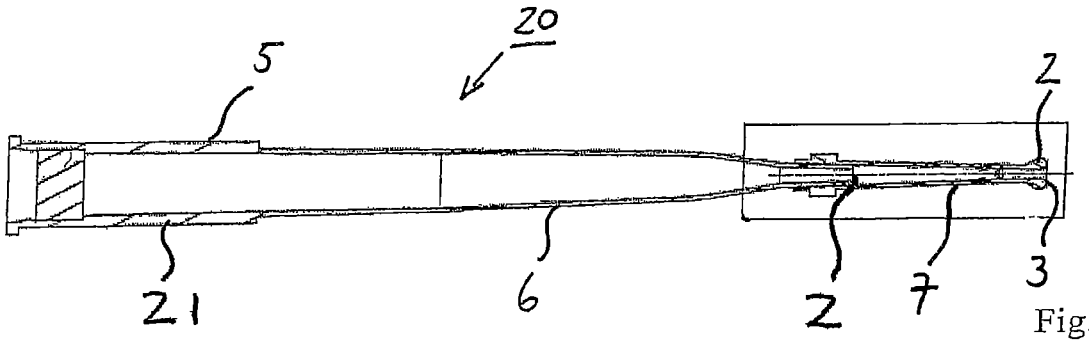
FIG. 5 is a longitudinal cross-section view of a pipette tip according to another embodiment wherein a liquid aspiration section is detachably connected.

FIG. 5 shows another pipette tip 20 wherein the liquid aspiration section 7 is detachably connected to a base tip 21 comprising a liquid containing section 6 and an attachment section 5. The liquid aspiration section 7 comprises a blunt distal end tip 2 with a distal end aspiration opening 3 and a plurality of further aspiration openings 4.

Figure 6:
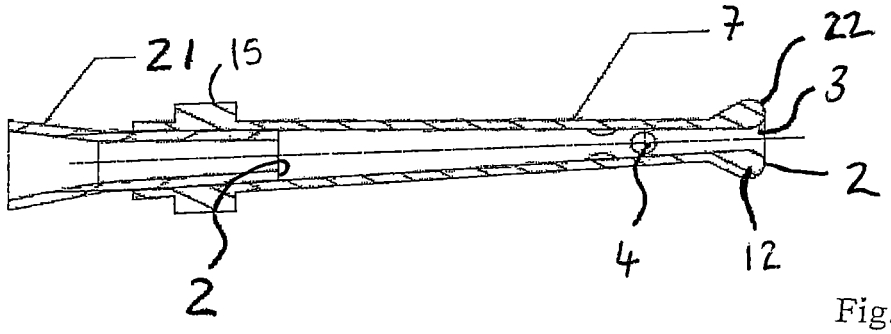
FIG. 6 is an enlarged view of the liquid aspiration section in FIG. 5 in greater detail.

FIG. 6 shows the liquid aspiration section 7 connected to the base tip 21 in FIG. 5 in greater detail. In contrast to the pipette tip 1 in FIGS. 1 to 4, the base tip 21 and the liquid aspiration section 7 in FIGS. 5 and 6 provide two separate parts connected to each other, wherein the liquid aspiration section 7 is an extension of the base tip 21. The coupling may be reversible or irreversible. The distal end aspiration opening 3 is provided with a rounded portion 22.

Figure 7:
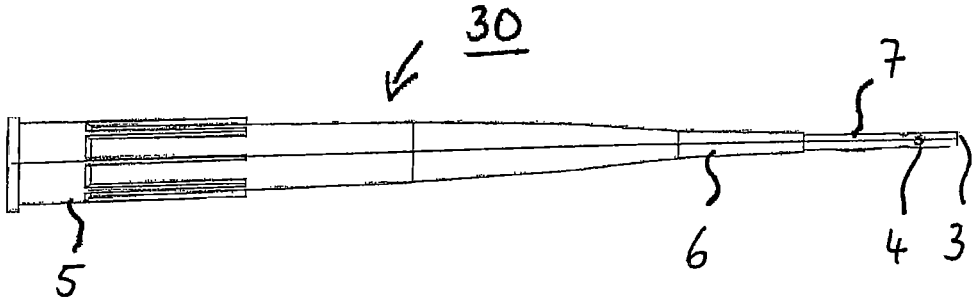
FIG. 7 is side view of a pipette tip according to another embodiment having a blunt distal end tip with a distal end aspiration opening and a plurality of further aspiration openings.

FIG. 7 shows a further pipette tip 30 having a blunt distal end aspiration opening 3 and a plurality of further aspiration openings 4.

Figure 8:
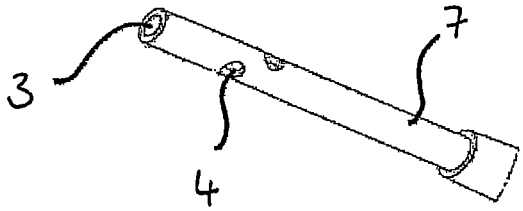
FIG. 8 is an enlarged perspective view of the liquid aspiration section of the pipette tip in FIG. 7 in greater detail.

FIG. 8 shows the liquid aspiration section 7 of the further pipette tip 30 in FIG. 7. In this case the liquid aspiration section 7 consists of a flexible tube, for example a silicon tube which may be connected, for example, to the base tip 21.

With the help of the pipette tip 1 according to the embodiments of the invention, it is possible to pipette liquid samples which contain clumps or otherwise non-pipettable elements which impede the distal end aspiration opening 3. The distal end aspiration opening 3 can still become blocked when using the pipette tip 1. However, an aspiration of the parts of the liquid to be pipetted then occurs through the at least one further aspiration opening 4 which is provided above the distal end aspiration opening 3 in the area of the liquid aspiration section 7. The liquid to be pipetted then reaches the inner space 8 of the pipette tip 1 through the at least one further aspiration opening 4. If the pipette tip 1 is removed from the sample to be pipetted, a release of tension follows through the at least one further aspiration opening 4 so that the low pressure in the inner space 8 of the pipette tip 1 no longer exists. This leads to the elements which are blocking the distal end aspiration opening 3, such as the blood clot in the case of congealed blood, virtually falling off. The liquid collected in the inner space 8 of the pipette tip 1 can then be subject to a further use such as an experimental analysis or examination.

As mentioned above, the distal end of the liquid aspiration section 7 has preferably a blunt shape, thereby providing a blunt tip portion, i.e., blunt distal end tip 2. This ensures that the distal end of the pipette tip does not penetrate or only very slightly penetrates the non-pipettable elements which block the distal end aspiration opening. This is why the non-pipettable and blocking elements, such as the blood clot in the case of congealed blood, loosen themselves once the pipette tip 1 has been removed from the sample to be pipetted. In still a further embodiment, the blunt tip portion is provided as a trumpet-like tip.

In one preferred embodiment, the pipette tip 1 and/or the liquid aspiration section 7 is produced as a disposable article. For this purpose, plastic is a suitable material for the pipette tip 1. In this case, the manufacture can be undertaken by injection molding. The pipette tip 1 could, however, also be made of metal, e.g. steel.

In a preferred embodiment, the projecting lip 11 is provided, wherein the projecting lip 11 surrounds the distal end aspiration opening 3.

According to a further embodiment, a collar 15 is provided to the liquid aspiration section 7 that is detachably connected to the base tip 21.

According to a preferred embodiment, the distal end aspiration opening 3 is provided with an opening diameter between about 0.4 mm to about 4 mm, preferably between about 1 mm to about 2.4 mm.

According to still another embodiment, the at least one further aspiration opening 4 is provided as a plurality of further aspiration openings.

In a preferred embodiment, at least some of the further aspiration openings 4 are circumferentially distributed. The pattern of distribution of the further openings 4 over the circumference can be of any kind. In another preferred embodiment, at least some of the further openings 4 are provided in opposite wall sections of the side wall 9.

In still a further embodiment, the further aspiration openings 4 are located at a variety of distances from the distal end aspiration opening 3. The optimal distance or distances may be dependent on the volume that the pipette tip 1 can aspirate, e.g. if the volume is less than 1 mL, the further aspiration openings 4 are preferably located at about 1 cm or less from the distal end, if the volume is greater than 1 mL, the further openings may be located at a greater distance from the distal end. According to a further embodiment, at least some of the further aspiration openings 4 are provided in the vicinity of the distal end aspiration opening 3. Preferably, at least some of the further aspiration openings are provided in a distance between about 0.25 cm to about 1.5 cm from the distal end aspiration opening 3. It is further preferred to have at least an majority of the further aspiration openings 4 located in a distance of less than about 1 cm from the distal end aspiration opening 3.

According to a preferred embodiment, at least some of the further aspiration openings 4 are located in recesses 13 provided on an outer surface of the side wall 9. In a preferred embodiment, the respective opening is located at an upper end of the recess 13. The recess 13 can be configured to provide a groove leading to the respective opening.

In another preferred embodiment, a sieve-like wall section is provided in the side wall 9 by the plurality of further aspiration openings 4. A sieve-like wall section is characterized by a high local density of further aspiration openings 4. For example, in the sieve-like wall section a distance between further aspiration openings 4 adjacently located is smaller than the diameter of the further aspiration openings.

According to one embodiment, the liquid containing section 6 and the liquid aspiration section 7 are comprised in a single piece. According to another embodiment, the liquid containing section 6 and the liquid aspiration section 7 are detachably connected, wherein the liquid aspiration section 7 comprises an attachment section to be connected to the liquid containing section 6 of a base tip 21, the base tip 21 being adapted to receive the liquid aspiration section 7. According to one embodiment, the base tip 21 is a standard tip available in the art.

According to a further embodiment, the liquid aspiration section 7 is at least partially flexible, e.g. being made of a flexible material. The liquid aspiration section 7 may be for example a flexible tube, e.g. made of silicon.

According to a preferred embodiment, the filter element 10 is provided in the inner space 8 of the pipette tip 1 surrounded by the side wall 9. In a preferred embodiment, the filter element 10 is made of a porous material. For example, a plastic material can be used for the filter element 10.

According to a preferred embodiment, the inner space 8 of the pipette tip 1 is adapted to receive a liquid volume between about 0.3 mL to about 4 mL, preferably between about 1 mL and about 2 mL.

According to a preferred embodiment, a method for pipetting a congealed blood sample comprises utilizing the pipette tip 1, 20, or 30 with the pipette device 14.

While particular embodiments and aspects of the present invention have been illustrated and described herein, various other changes and modifications may be made without departing from the spirit and scope of the invention. Moreover, although various inventive aspects have been described herein, such aspects need not be utilized in combination. It is therefore intended that the appended claims cover all such changes and modifications that are within the scope of this invention.

What is claimed is:

1. A pipette tip for pipetting a congealed blood sample comprising:

an attachment section configured to be attached to a dispensing device;

a liquid containing section configured to receive at least part of an aspired liquid sample; and a liquid aspiration section, connected to the liquid containing section, and comprising a distal end aspiration opening and at least one further aspiration opening in a side wall, wherein a projecting lip is provided, the projecting lip surrounding the distal end aspiration opening; and wherein the projecting lip forms a trumpet shaped end such that a blood clot of the sample temporarily attaches and is retained to the distal end to prevent the blood clot from blocking the at least one further aspiration opening in the side wall during pipetting of the congealed blood sample with the pipette tip.

2. The pipette tip according to claim 1, wherein a distal end of the liquid aspiration section is provided with a blunt shape.

3. The pipette tip according to claim 1, wherein the distal end aspiration opening is provided with an opening diameter between about 0.4 mm to about 4 mm.

4. The pipette tip according to claim 1, wherein the distal end aspiration opening is provided with an opening diameter between about 1 mm to about 2.4 mm.

5. The pipette tip according to claim 1, wherein the at least one further aspiration opening is provided as a plurality of further aspiration openings.

6. The pipette tip according to claim 5, wherein at least some of the plurality of further aspiration openings are circumferentially distributed.

7. The pipette tip according to claim 5, wherein at least some of the plurality of the further aspiration openings are located at a variety of distances from the distal end aspiration opening.

8. The pipette tip according to claim 5, wherein at least some of the plurality of the further aspiration openings are located in recesses provided on an outer surface of the side wall.

9. The pipette tip according to claim 5, wherein the plurality of further aspiration openings define a sieve-like wall section in the side wall.

10. The pipette tip according to claim 1, wherein the liquid containing section and the liquid aspiration section are detachably connected.

11. The pipette tip according to claim 1, wherein the liquid aspiration section is at least partially flexible.

12. The pipette tip according to claim 1, wherein the liquid aspiration section is configured to be attached to a base tip.

13. The pipette tip according to claim 1, wherein a filter element is provided in an inner space surrounded by the side wall.

14. The pipette tip according to claim 1, wherein the pipette tip is adapted to receive a liquid volume between about 0.3 mL and about 4 mL.

15. The pipette tip according to claim 1, wherein the pipette tip is adapted to receive a liquid volume between about 1 mL and about 2 mL.

16. The pipette tip according to claim 1, wherein a collar is provided to the liquid aspiration section.

17. A method for pipetting a congealed blood sample which comprises providing the pipette tip of claim 1 and pipetting a congealed blood sample.

* * * * *

UNITED STATES PATENT AND TRADEMARK OFFICE

CERTIFICATE OF CORRECTION

PATENT NO. : 8,460,617 B2
APPLICATION NO. : 12/512171
DATED : June 11, 2013
INVENTOR(S) : Gottlieb Schacher et al.

It is certified that error appears in the above-identified patent and that said Letters Patent is hereby corrected as shown below:

Title Page
Foreign Application Priority Data:
"EP 08013657" should read --EP 08013657.5--; and In the Specification
Col. 4, Lines 29-30, "an majority" should read --a majority--.

Signed and Sealed this
First Day of October, 2013

Teresa Stanek Rea
*Deputy Director of the United States Patent and Trademark Office*